US012442319B2

(12) United States Patent
Kawano et al.

(10) Patent No.: US 12,442,319 B2
(45) Date of Patent: Oct. 14, 2025

(54) DECOMPRESSION DEVICE AND ENGINE

(71) Applicant: SUZUKI MOTOR CORPORATION, Hamamatsu (JP)

(72) Inventors: Yuichi Kawano, Hamamatsu (JP); Hidekuni Ota, Hamamatsu (JP); Shintaro Ishida, Hamamatsu (JP)

(73) Assignee: SUZUKI MOTOR CORPORATION, Hamamatsu (JP)

( * ) Notice: Subject to any disclaimer, the term of this patent is extended or adjusted under 35 U.S.C. 154(b) by 0 days.

(21) Appl. No.: 18/482,551

(22) Filed: Oct. 6, 2023

(65) Prior Publication Data

US 2024/0151166 A1 May 9, 2024

(30) Foreign Application Priority Data

Nov. 4, 2022 (JP) ..... 2022-177553

(51) Int. Cl.
*F01L 13/08* (2006.01)
*F01L 1/047* (2006.01)
*F01L 13/00* (2006.01)

(52) U.S. Cl.
CPC ..... *F01L 13/085* (2013.01); *F01L 1/047* (2013.01); *F01L 2013/108* (2013.01); *F01L 2810/04* (2013.01); *F01L 2820/035* (2013.01)

(58) Field of Classification Search
CPC ... F01L 2820/035; F01L 13/085; F01L 1/047; F01L 2001/0475; F01L 2001/0473; F01L 13/08; F01L 1/462; F01L 2013/108
See application file for complete search history.

(56) References Cited

U.S. PATENT DOCUMENTS 5,632,238 A * 5/1997 Furukawa ..... B60W 10/06 290/34
2004/0261744 A1* 12/2004 Tsutsumi ..... F01L 13/085 123/182.1
2006/0048736 A1* 3/2006 Sugiura ..... F01L 13/085 123/182.1

FOREIGN PATENT DOCUMENTS

EP 2821603 A1 * 1/2015 ..... F01L 13/085
EP 3203056 A1 * 8/2017 ..... F01L 13/02
JP H09170414 A * 6/1997 ..... F01L 13/08
JP 2001193428 A * 7/2001 ..... F01L 13/08
JP 2004052639 A * 2/2004 ..... F01L 13/08
(Continued)

OTHER PUBLICATIONS

JP 2011149340, English language machine translation (Year: 2011).*

*Primary Examiner* — Wesley G Harris
(74) *Attorney, Agent, or Firm* — Stein IP, LLC

(57) ABSTRACT

A decompression device is attached to an exhaust camshaft, and the exhaust camshaft is supported by a cylinder head. The decompression device includes a decompression camshaft formed with a decompression cam that can protrude and be immersed with respect to a base circle of an exhaust cam of the exhaust camshaft, a decompression arm that moves in an opening direction due to centrifugal force accompanying rotation of the exhaust camshaft to protrude the decompression cam, and a spring that moves the decompression arm in a closing direction by spring force resisting the centrifugal force to immerse the decompression cam. In the decompression device, the opening direction of the decompression arm can be changed in a same direction or in an opposite direction to a rotation direction of the exhaust camshaft for each cylinder.

3 Claims, 8 Drawing Sheets

(56) References Cited

FOREIGN PATENT DOCUMENTS

| | | | | | |
|---|---|---|---|---|---|
| JP | 2009114969 | A | * | 5/2009 | ..... F02D 15/00 |
| JP | 2011058474 | A | * | 3/2011 | ..... F01L 13/08 |
| JP | 2011149340 | A | * | 8/2011 | ..... F01L 13/08 |
| JP | 2020063729 | A | * | 4/2020 | ..... F01L 13/08 |
| JP | 6934905 | B2 | | 8/2021 | |

* cited by examiner

DECOMPRESSION DEVICE AND ENGINE

CROSS-REFERENCE TO RELATED APPLICATIONS

The disclosure of Japanese Patent Application No. 2022-177553 filed on Nov. 4, 2022, including specification, drawings and claims is incorporated herein by reference in its entirety.

TECHNICAL FIELD

The present invention relates to a decompression device and an engine.

BACKGROUND ART

There is known a decompression device that relieves a pressure in a cylinder body when starting an engine to start the engine smoothly (see, for example, JP6934905B). The decompression device switches decompression operation and release by making a decompression cam protrude from and be immersed under a cam base surface of an exhaust cam. A C-plate-shaped decompression arm is provided around a camshaft, a base end of the decompression arm on a leading side in a rotation direction of the camshaft is swingably connected to a camshaft side, and a tip end of the decompression arm on a trailing side in the rotation direction of the camshaft is connected to the decompression cam.

When the engine is started, the decompression arm is pulled to an operating position by a spring and the decompression arm is not moved from the operating position. Here, the decompression cam protrudes from the cam base surface and hits a valve tappet, opening an exhaust valve slightly and improving engine startability. On the other hand, when a rotation speed of the camshaft increases after the engine is started, centrifugal force moves the decompression arm from the operating position to a releasing position. Here, the decompression cam is immersed under the cam base surface, and the exhaust valve is kept closed because the decompression cam does not hit the valve tappet.

SUMMARY OF INVENTION

Normally, the decompression arm is connected to the camshaft side on the leading side in the rotation direction of the camshaft and the opening direction of the decompression arm is set to the same as the rotation direction of the camshaft so that the decompression is not released when the engine is started. However, during operation after the engine is started, the decompression arm may move from the releasing position to the operating position when a rotational fluctuation increases toward an acceleration side. In a multi-cylinder engine, when the decompression passes over the valve tappet, there is a cylinder that is affected by the rotational fluctuation, and there is a problem that the decompression malfunctions during operation and causes compression loss and abnormal noise.

A decompression device and an engine of a present embodiment can stabilize decompression and preventing compression loss and abnormal noise during operation.

An aspect of the present embodiment is a decompression device that is attached to an exhaust camshaft while the exhaust camshaft is supported by a cylinder head, the decompression device including a decompression camshaft formed with a decompression cam that can protrude and be immersed with respect to a base circle of an exhaust cam of the exhaust camshaft, a decompression arm that moves in an opening direction due to centrifugal force accompanying rotation of the exhaust camshaft to protrude the decompression cam, and a spring that moves the decompression arm in a closing direction by spring force resisting the centrifugal force to immerse the decompression cam. In the decompression device, the opening direction of the decompression arm can be changed in a same direction or in an opposite direction to a rotation direction of the exhaust camshaft for each cylinder.

According to the decompression device of the aspect of the present embodiment, the opening direction of the decompression arm can be changed for each cylinder of the engine. In a normal cylinder, the opening direction of the decompression arm is set in the same direction to the rotation direction of the exhaust camshaft so that the decompression is not easily released when the engine is started. In a cylinder which is affected by a rotational fluctuation when the decompression cam passes over the valve tappet during operation, the opening direction of the decompression arm is set in the opposite direction to the rotation direction of the exhaust camshaft. The decompression does not operate by an influence of the rotational fluctuation and the occurrence of compression loss and abnormal noise is prevented. Since there is no need to adjust a weight of the decompression arm or a load of the spring, an increase in working hours and design changes can be prevented.

DESCRIPTION OF EMBODIMENTS

An exhaust camshaft is supported by a cylinder head of an aspect of the present embodiment, and a decompression device is attached to the exhaust camshaft for each cylinder of the cylinder head. The decompression device includes a decompression camshaft, a decompression arm, and a spring. The decompression camshaft is formed with a decompression cam that can protrude and be immersed with respect to a base circle of an exhaust cam of the exhaust camshaft. Centrifugal force accompanying rotation of the exhaust camshaft moves the decompression arm in an opening direction to protrude the decompression cam, and spring force of the spring that resists the centrifugal force moves the decompression arm in a closing direction to immerse the decompression cam. The opening direction of the decompression arm can be changed in a same direction or in an opposite direction to a rotation direction of the exhaust camshaft for each cylinder. In a normal cylinder, an opening direction of the decompression arm is set in the same direction to the rotation direction of the exhaust camshaft so that the decompression is not easily released when the engine is started. In a cylinder which is affected by a rotational fluctuation when the decompression cam passes over a valve tappet during operation, the opening direction of the decompression arm is set in an opposite direction to the rotation direction of the exhaust camshaft. The decompression does not operate by an influence of the rotational fluctuation and occurrence of compression loss and abnormal noise is prevented. Since there is no need to adjust a weight of the decompression arm or a load of the spring, an increase in working hours and design changes can be prevented.

Example

Figure 1:
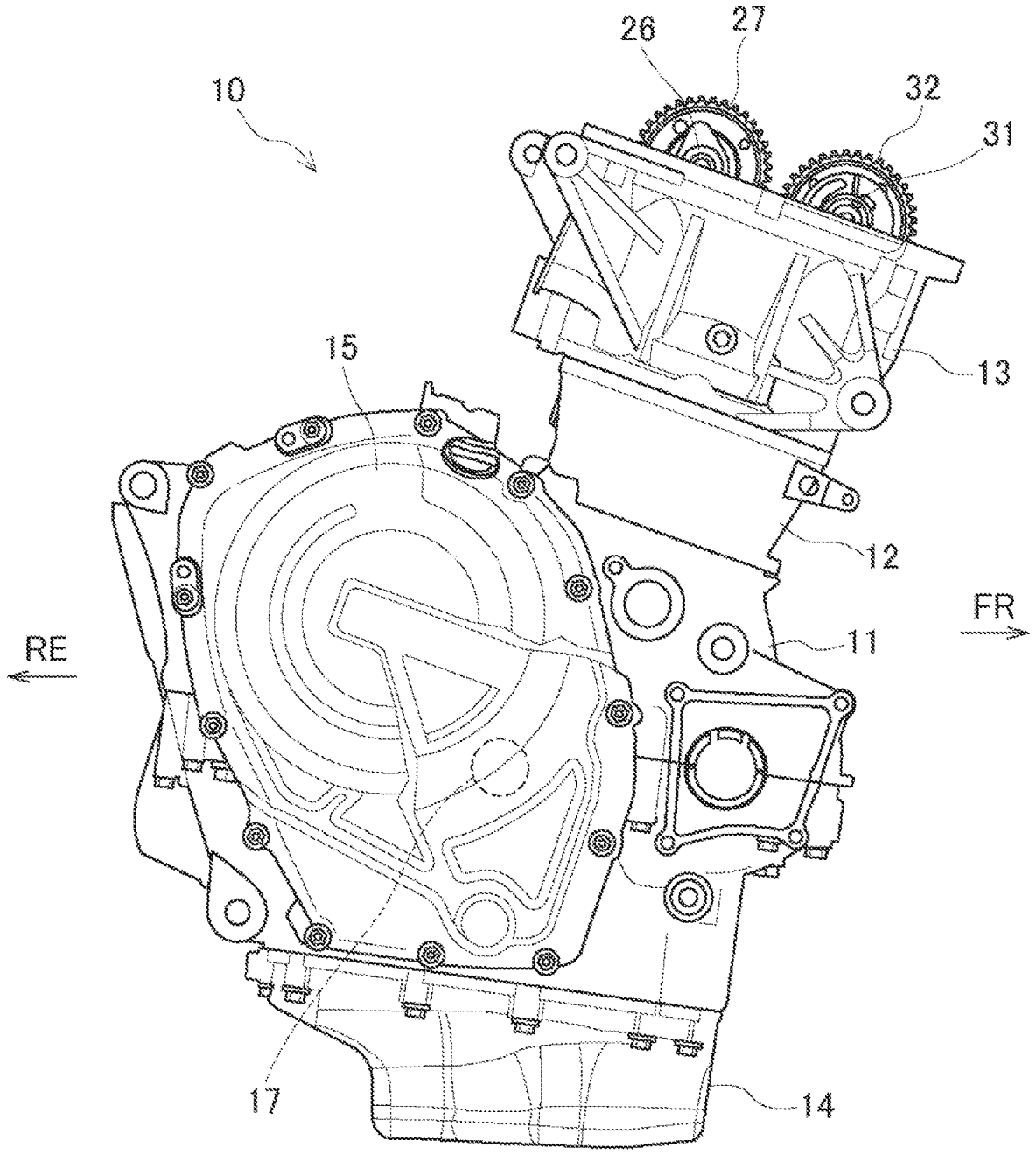
FIG. 1 is a right side view of an engine of a present example.
Figure 2:
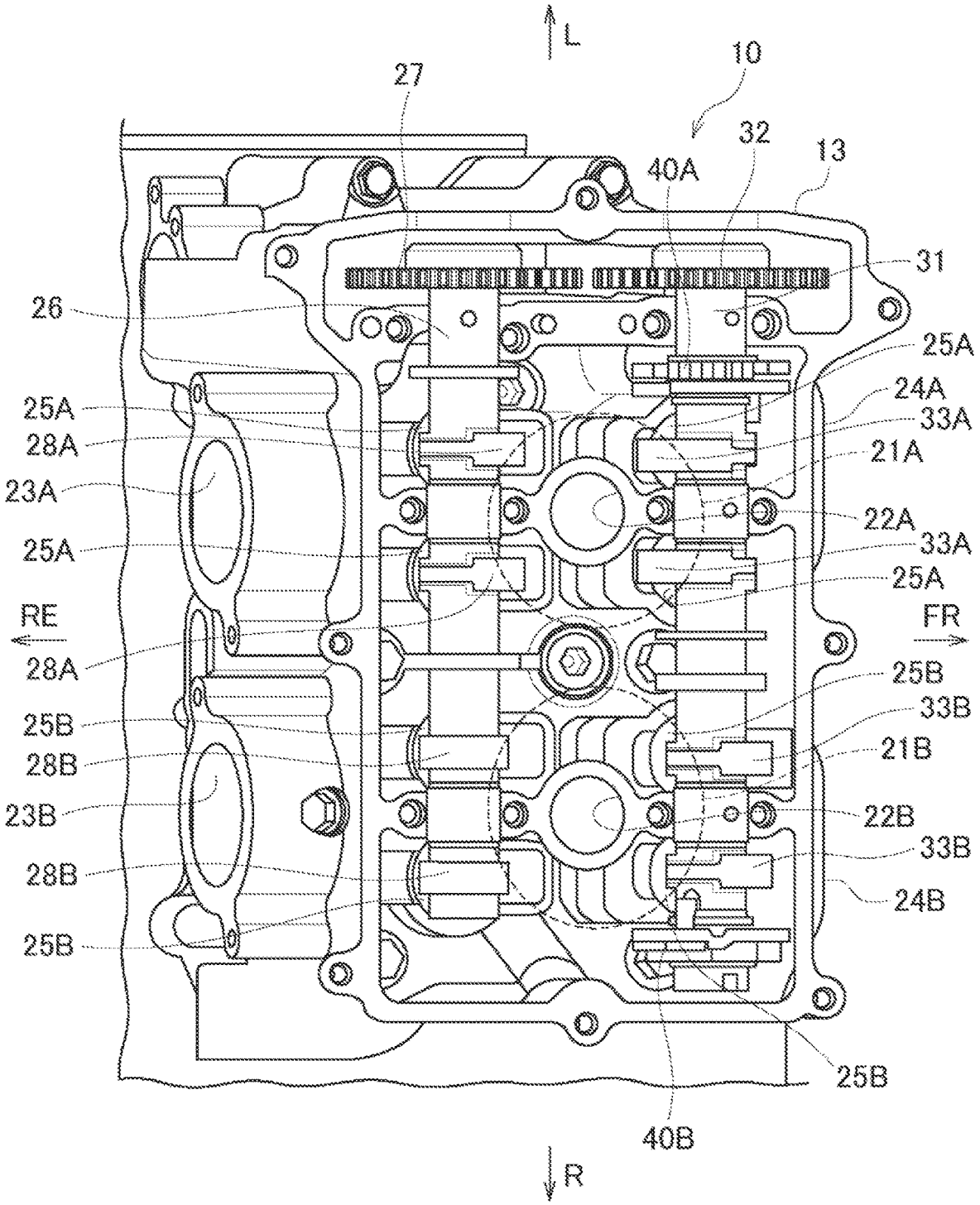
FIG. 2 is a top view of a cylinder head of the present example.
Figure 3A:
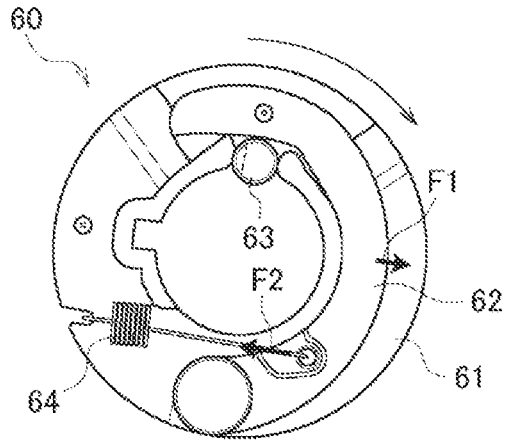
FIGS. 3A to 3C are explanatory views of a decompression operation of a decompression device of a comparative example.
Figure 3B:
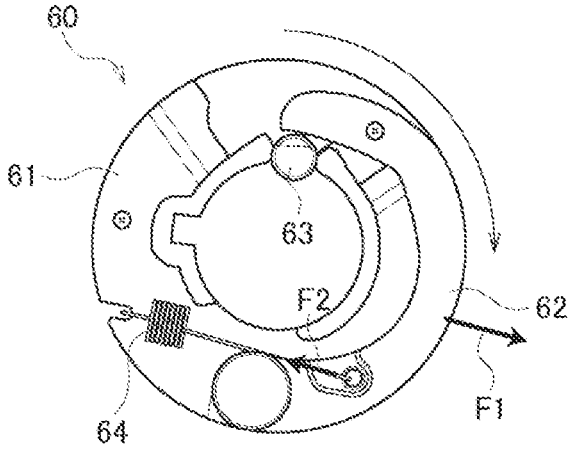
Figure 3C:
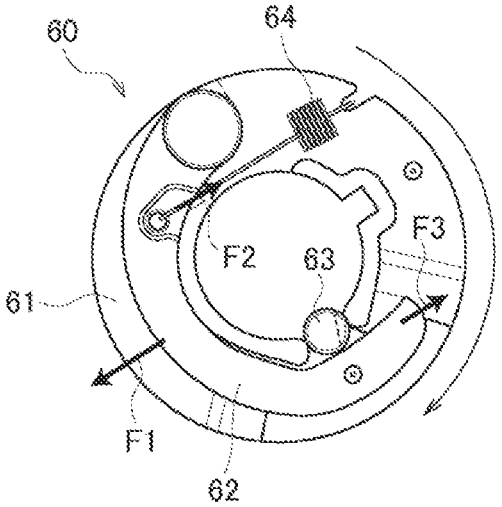
Figure 4:
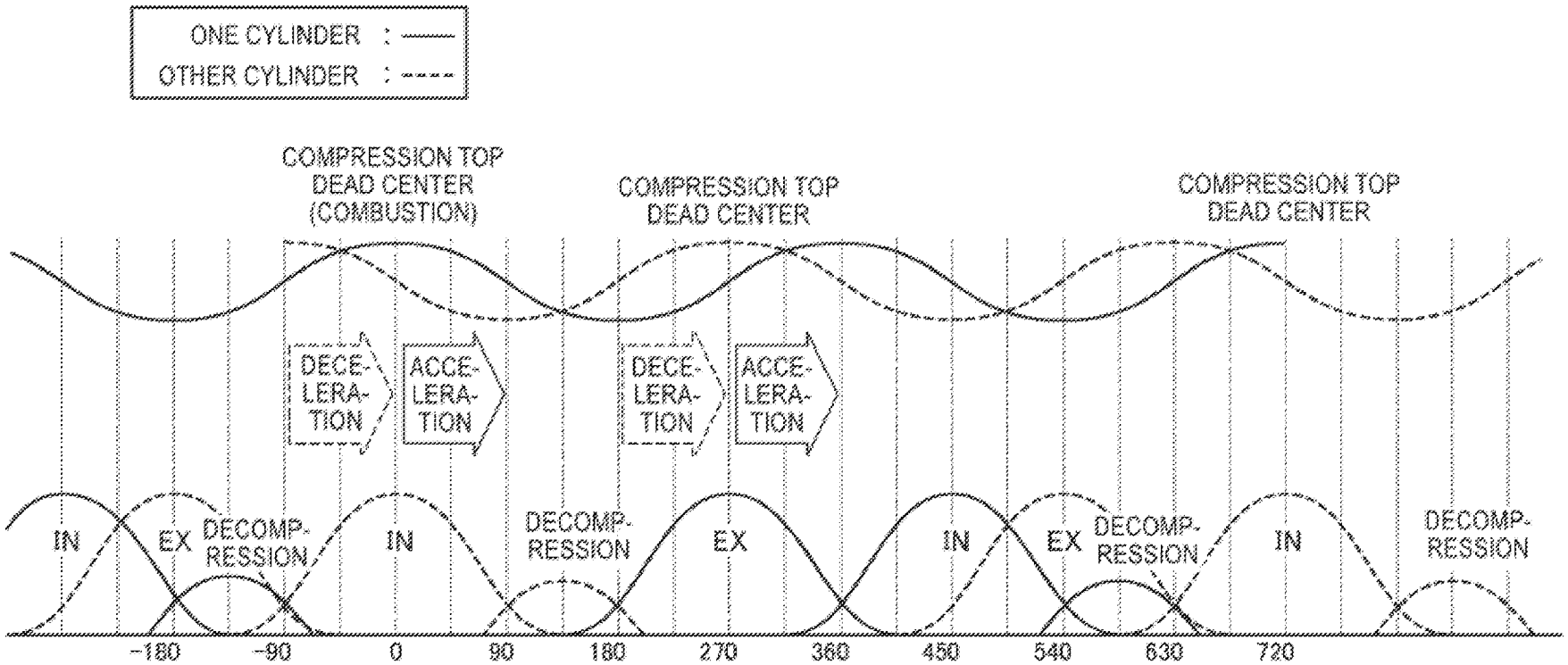
FIG. 4 is a diagram illustrating movement of a piston and operation time of the decompression device.

An engine of a present example will be described below with reference to the accompanying drawings. FIG. 1 is a right side view of the engine of the present example. FIG. 2 is a top view of a cylinder head of the present example. FIGS. 3A to 3C are explanatory views of a decompression operation of a decompression device of a comparative example. FIG. 4 is a diagram illustrating movement of a piston and operation time of the decompression device. In the following figures, an arrow FR indicates the front of a vehicle, an arrow RE indicates the rear of the vehicle, an arrow L indicates the left of the vehicle, and an arrow R indicates the right of the vehicle.

As illustrated in FIG. 1, an engine 10 is a 2-cylinder 4-cycle engine, and is mounted on a straddle-type vehicle such as a motorcycle. A crankshaft 17 is accommodated in a crankcase 11 of the engine 10, and a cylinder assembly in which a cylinder body 12, a cylinder head 13, and a cylinder head cover (not illustrated) are stacked is attached to an upper part of the crankcase 11. An oil pan 14 that stores lubricating and cooling oil is attached to the lower portion of the crankcase 11. A clutch cover 15 is attached to a right side surface of the crankcase 11 to cover a clutch chamber in the case.

As illustrated in FIG. 2, the cylinder body 12 (see FIG. 1) is formed with cylinders 21A and 21B, and the cylinder head 13 is formed with plug holes 22A and 22B communicating with the cylinders 21A and 21B. Intake ports 23A and 23B for the cylinders 21A and 21B are formed on a rear surface of the cylinder head 13, and exhaust ports 24A and 24B for the cylinders 21A and 21B are formed on a front surface of the cylinder head 13. The cylinder head 13 is provided with two intake valves (not illustrated) and two exhaust valves (not illustrated) for the cylinder 21A, and two intake valves and two exhaust valves for the cylinder 21B. Valve tappets 25A and 25B for each valve are exposed from a bottom surface of the cylinder head 13.

An intake camshaft 26 is supported on a rear side of the cylinder head 13, and an exhaust camshaft 31 is supported on a front side of the cylinder head 13. The intake camshaft 26 and the exhaust camshaft 31 extend in a left-right direction, and an intake cam sprocket 27 and an exhaust cam sprocket 32 are respectively provided at left end portions of the intake camshaft 26 and the exhaust camshaft 31. The intake camshaft 26 is formed with four intake cams 28A and 28B that are in contact with the valve tappets 25A and 25B of the intake valves. The exhaust camshaft 31 is formed with four exhaust cams 33A and 33B that are in contact with the valve tappets 25A and 25B of the exhaust valves.

When starting the engine 10, it is necessary to rotate the crankshaft 17 (see FIG. 1) using a starter motor or the like. However, when the torque for passing over a compression top dead center of the piston is high, it is difficult to rotate the crankshaft 17 smoothly. Therefore, decompression devices 40A and 40B are attached to the exhaust camshaft 31 for respective cylinders 21A and 21B. When the engine is started, decompression operates to slightly open the exhaust valves of the cylinders 21A and 21B. The pressure is released from the cylinders 21A and 21B, so the torque for passing over the compression top dead center of the piston is reduced, and thus the engine 10 is started smoothly.

As illustrated in FIG. 3A, in a decompression device 60 of the comparative example, a base end of a decompression arm 62 is connected to a decompression holder 61 on a leading side in a rotational direction of a camshaft, and a tip end of the decompression arm 62 is connected to a decompression cam 63 on a trailing side in the rotational direction of the camshaft. That is, an opening direction of the decompression arm 62 is the same direction as the rotation direction of the camshaft. When the engine is started, centrifugal force F1 acting on the decompression arm 62 is weak, and the decompression arm 62 is pulled by spring force F2 of a spring 64. When the decompression arm 62 is closed, the decompression cam 63 protrudes from a base circle of the exhaust cam during a compression stroke to perform decompression.

On the other hand, as illustrated in FIG. 3B, the centrifugal force F1 acting on the decompression arm 62 increases during operation after the engine is started, and the decompression arm 62 is opened resisting the spring force F2 of the spring 64. When the decompression arm 62 is open, the decompression cam 63 is immersed into the base circle of the exhaust cam during the compression stroke to release decompression. However, in a multi-cylinder engine, acceleration and deceleration characteristics of the engine become irregular depending on the combination of each cylinder cycle. Due to such characteristics, opening and closing of the decompression arm 62 may become unstable in some cylinders under an influence of irregular acceleration and deceleration.

For example, as illustrated in FIG. 3C, when a rotational fluctuation increases to the acceleration side after a rotation speed drops below idling, inertial force F3 acts strongly on the decompression arm 62 in addition to the centrifugal force F1 and the spring force F2 of the spring 64. Since the rotation direction of the camshaft and the opening direction of the decompression arm 62 are the same, the inertial force F3 acts on the decompression arm 62 in a closing direction, and the decompression arm 62 is moved in the closing direction by the spring force F2 and the inertial force F3. As such, when a sudden change in a rotational fluctuation occurs during engine operation, decompression may occur, causing compression loss or abnormal noise.

As illustrated in FIG. 4, in an engine in which combustion intervals of two cylinders are uneven (for example, 270 degrees and 450 degrees), the decompression operation time of the other cylinder comes immediately after the combustion of one cylinder. When combustion of one cylinder causes the rotation speed to fluctuate rapidly on the acceleration side, the decompression of the other cylinder exceeds the valve tappet, and thus the decompression of the other cylinder is strongly affected by the rotational fluctuation. In a decompression device 60 of the comparative example, the decompression arm 62 is moved in the closing direction to be positioned between an operating position and a releasing position, and the decompression cam 63 is flipped by the valve tappet to generate abnormal noise.

As such, the decompression arm 62 does not move when passing over the valve tappet in one cylinder in which combustion occurs first, but the decompression arm 62 moves when passing over the valve tappet in the other cylinder in which combustion occurs later. In particular, after the rotation speed drops below idling, abnormal noise is likely to occur when the rotation speed suddenly fluctuates to the acceleration side due to combustion in one cylinder. Therefore, in the engine 10 of the present example, the decompression devices 40A and 40B that can change opening directions of decompression arms 51A and 51B (see FIGS. 5A and 5B) are used, so the opening directions of the decompression arms 51A and 51B are changed to be suitable for the cylinders 21A and 21B.

Figure 5A:
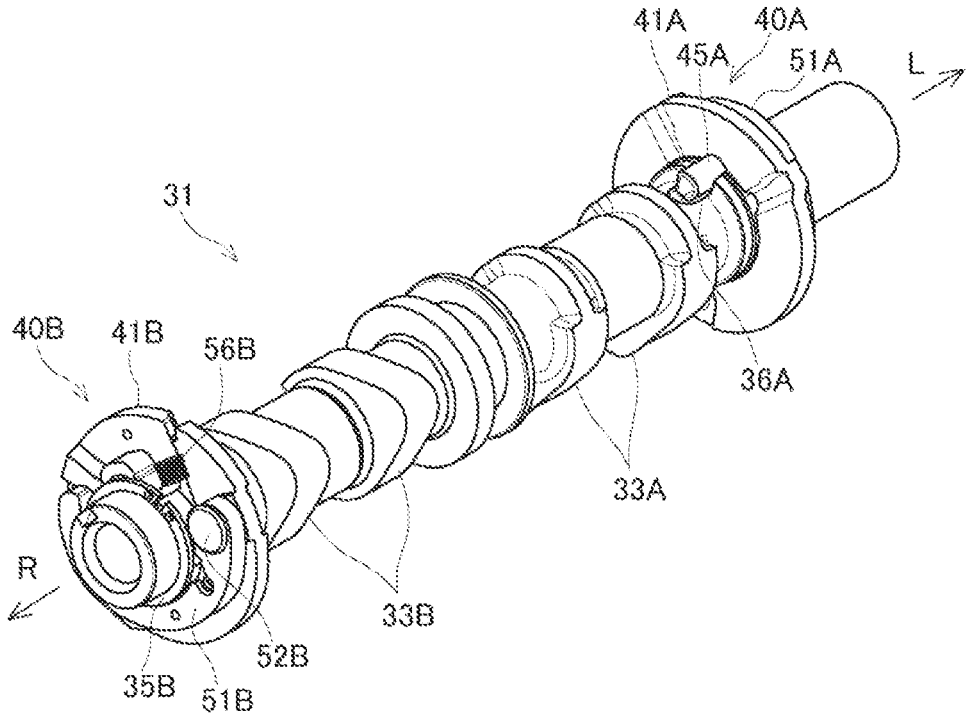
FIGS. 5A and 5B are perspective views of an exhaust camshaft of the present example.
Figure 5B:
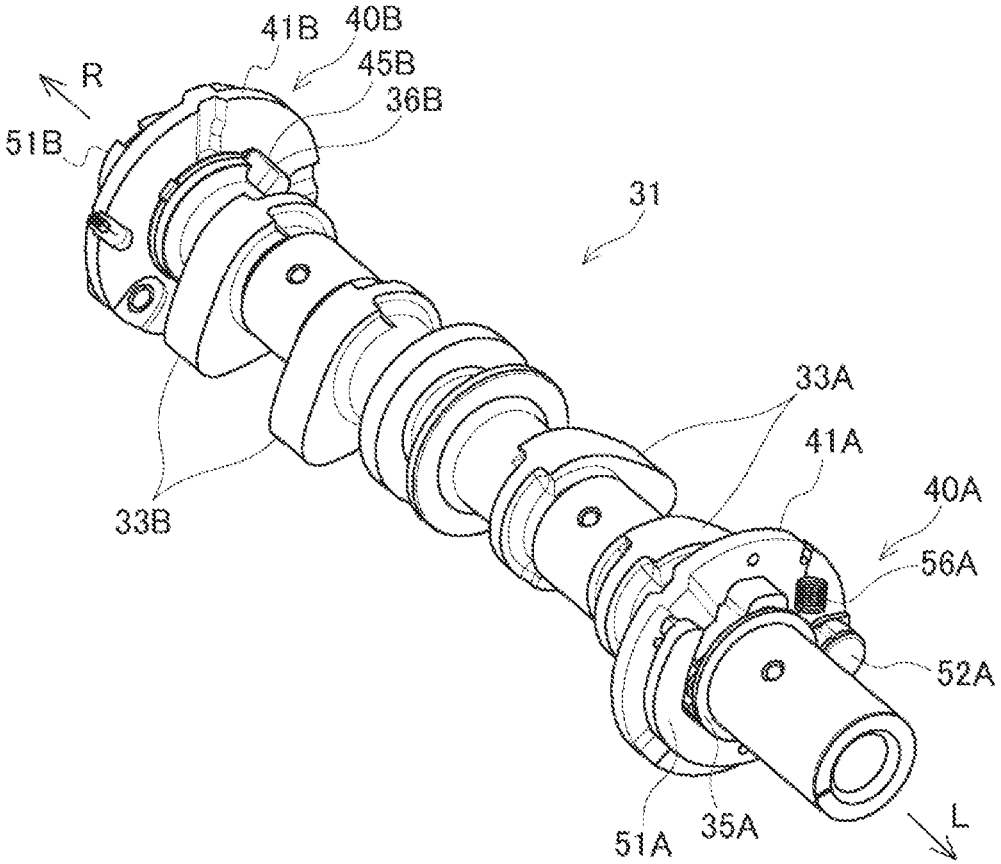
Figure 6A:
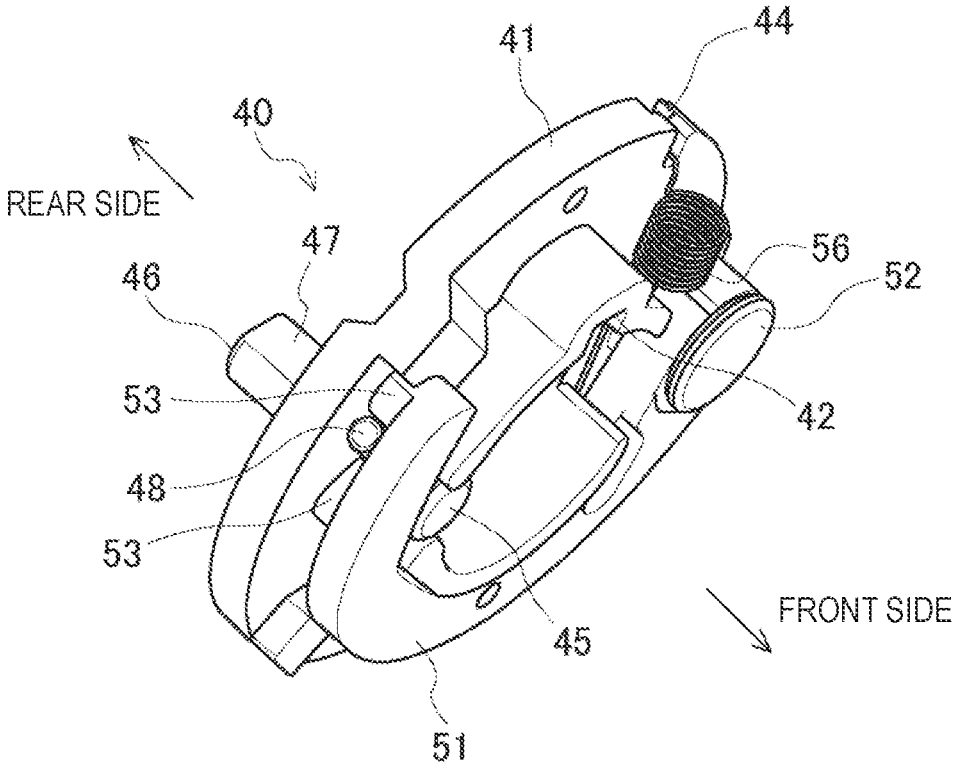
FIGS. 6A and 6B are perspective views of the decompression device of the present example.
Figure 6B:
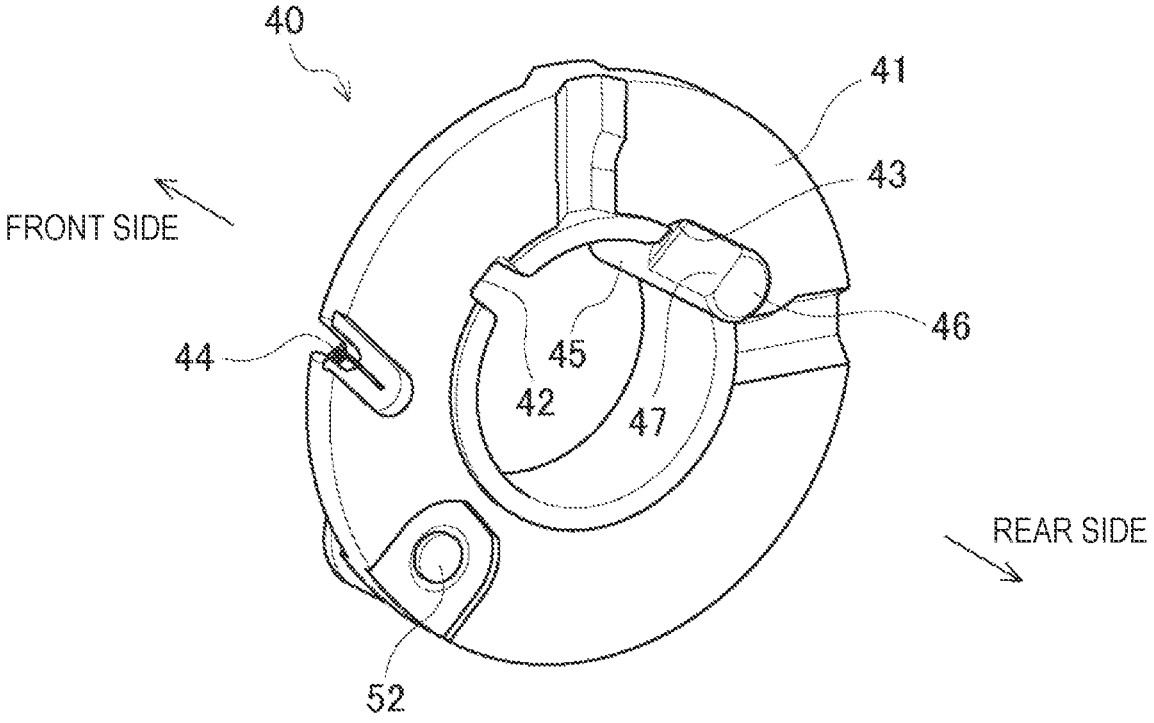

The decompression device will be described with reference to FIGS. 5A to 6B. FIGS. 5A and 5B are perspective views of the exhaust camshaft of the present example. FIGS. 6A and 6B are perspective views of the decompression device of the present example. The decompression devices are denoted by A and B, but A and B may be omitted when a certain decompression device is not specified.

As illustrated in FIGS. 5A and 5B, the left half of the exhaust camshaft 31 is provided with two exhaust cams 33A for the cylinder 21A, and the right half of the exhaust camshaft 31 is provided with two exhaust cams 33B for the cylinder 21B. The exhaust cams 33A and 33B are installed with a phase difference of 270 degrees. The exhaust camshaft 31 is provided with the decompression devices 40A and 40B such that the four exhaust cams 33A and 33B are interposed therebetween. The decompression devices 40A and 40B are retained on the exhaust camshaft 31 by circlips 35A and 35B. An outer peripheral surface of the exhaust camshaft 31 is formed with accommodation grooves 36A and 36B for decompression camshafts 45A and 45B.

As illustrated in FIGS. 5A to 6B, the decompression device 40 is attached to the outer peripheral surface of the exhaust camshaft 31 via a decompression holder 41. The decompression camshaft 45, the decompression arm 51, and a spring 56 are held by the decompression holder 41. The decompression holder 41 is formed in a shape of a ring plate with an opening at a center, and an inner edge of the decompression holder 41 protrudes cylindrically toward a front side. A key groove 42 for the exhaust camshaft 31 and an accommodation groove 43 for the decompression camshaft 45 are formed on the inner edge of the decompression holder 41, and a hanging groove 44 for the spring 56 is formed on an outer edge of the decompression holder 41.

The decompression camshaft 45 is accommodated in the accommodation groove 36 of the exhaust camshaft 31 and the accommodation groove 43 of the decompression holder 41 to be swingable. One end side of the decompression camshaft 45 protrudes from a back surface of the decompression holder 41, and an outer peripheral surface of the protruding portion is flatly notched to form a decompression cam 46 having a D-shaped cross section. By swinging the decompression cam 46, an orientation of a flat surface 47 is changed, so that the decompression cam 46 is formed to protrude and be immersed with respect to the base circle of an exhaust cam 33. A decompression pin 48 is fixed to the other end side of the decompression camshaft 45, and the decompression cam 46 swings when the decompression pin 48 is operated.

The decompression arm 51 is formed in a C-plate shape, and a base end of the decompression arm 51 is connected to a surface of the decompression holder 41 through a pivot 52 to be swingable. A pair of holding claws 53 are formed on a tip end side of the decompression arm 51, and a decompression pin 48 of the decompression camshaft 45 is inserted between the pair of holding claws 53 to connect the decompression arm 51 and the decompression camshaft 45. The decompression arm 51 swings under the centrifugal force accompanying the rotation of the exhaust camshaft 31, and the swinging of the decompression arm 51 operates the decompression pin 48. A hanging hole 54 (see FIGS. 7A and 7B) for the spring 56 is formed on the base end side of the decompression arm 51.

One end of the spring 56 is hooked in the hanging groove 44 of the decompression holder 41 and the other end of the spring 56 is hooked in the hanging hole 54 of the decompression arm 51. The decompression arm 51 is pulled in a closing direction by the spring force of the spring 56. In such a decompression device 40, the decompression arm 51 is moved in an opening direction by the centrifugal force accompanying the rotation of the exhaust camshaft 31, and the decompression cam 46 protrudes from the base circle of the exhaust cam 33. In the decompression device 40, the decompression arm 51 is moved in a closing direction by the spring force of the spring 56 that resists the centrifugal force, and the decompression cam 46 is immersed in the base circle of the exhaust cam 33.

The opening direction of the decompression arm 51 can be changed to the same direction as or opposite direction to the rotation direction of the exhaust camshaft 31 depending on an attachment orientation of the decompression holder 41 with respect to the exhaust camshaft 31. The engine 10 of the present example is a two-cylinder engine with unequal combustion intervals of 270 degrees and 450 degrees, and the decompression operation time of the cylinder 21B comes immediately after the combustion of the cylinder 21A. Therefore, similar decompression devices 40 are used on the cylinder 21A side in which combustion occurs first and the cylinder 21B side in which combustion occurs later, but the decompression devices 40 of the cylinder 21A and the cylinder 21B are attached to the exhaust camshaft 31 in an opposite direction to each other.

Figure 7A:
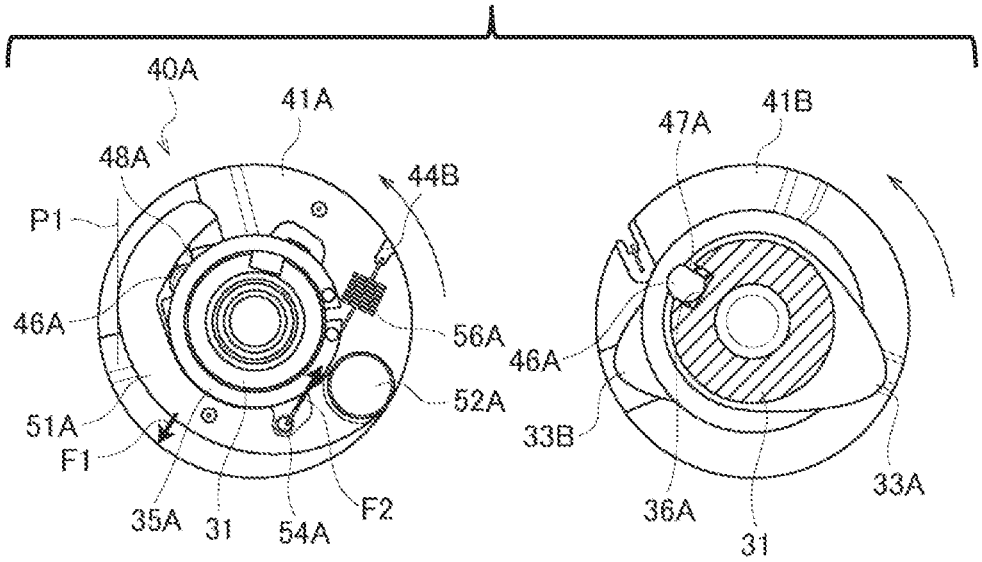
FIGS. 7A and 7B are explanatory views of a decompression operation of the decompression device for one cylinder of the present example.
Figure 7B:
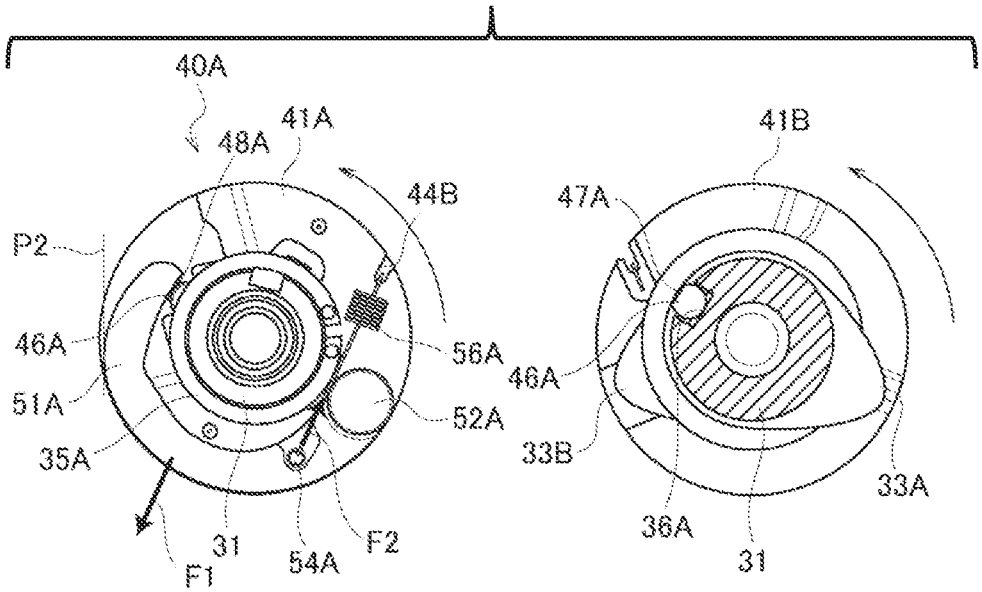
Figure 8A:
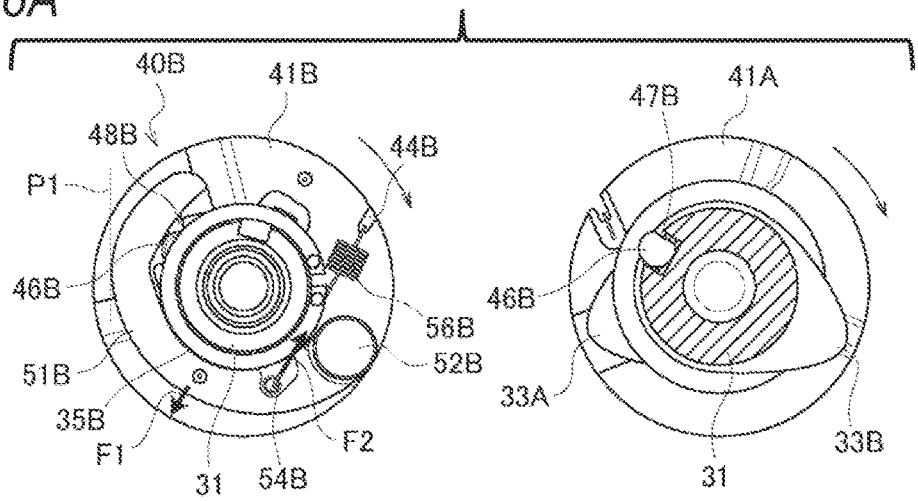
FIGS. 8A to 8C are explanatory views of the decompression operation of the decompression device for the other cylinder of the present example.
Figure 8B:
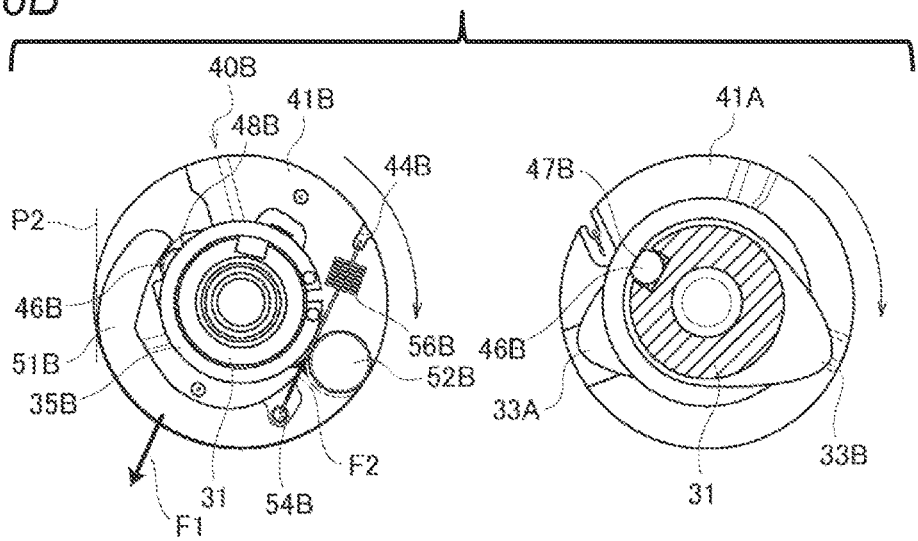
Figure 8C:
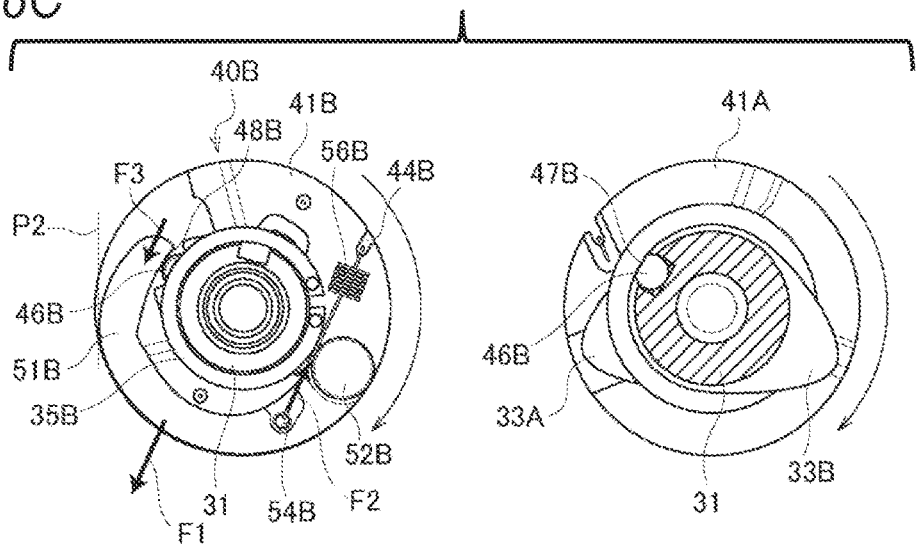

The decompression operation will be described with reference to FIGS. 7A to 8C. FIGS. 7A and 7B are explanatory views of the decompression operation of the decompression device of one cylinder in the present example. FIGS. 8A to 8C are explanatory views of the decompression operation of the decompression device of the other cylinder in the present example.

As illustrated in FIG. 7A, the decompression device 40A for the cylinder 21A in which combustion occurs first is attached to the exhaust camshaft 31 in the same orientation as the decompression device 60 of the comparative example. The base end of the decompression arm 51A is connected to the decompression holder 41A on a leading side of the exhaust camshaft 31 in the rotation direction, and the tip end of the decompression arm 51A is connected to the decompression cam 46A on a trailing side of the exhaust camshaft 31 in the rotation direction. That is, the opening direction of the decompression arm 51A of the decompression device 40A is the same as the rotation direction of the exhaust camshaft 31. The decompression arm 51A is swingably supported between a decompression operating position P1 and a decompression releasing position P2.

When the engine is started, the centrifugal force F1 does not strongly act on the decompression arm 51A. The decompression arm 51A is pulled in the closing direction by the spring force F2 of the spring 56A, and the decompression arm 51A is positioned at the decompression operating position P1. The decompression cam 46A is connected to the tip end of the decompression arm 51A via the decompression pin 48A, and the flat surface 47A of the decompression cam 46A faces the side surface of the accommodation groove 36A. Therefore, the decompression cam 46A partially protrudes from the base circle of the exhaust cam 33A and comes into contact with the valve tappet 25A (see FIG. 2) from a circular surface side to operate decompression.

As illustrated in FIG. 7B, the centrifugal force F1 acts strongly on the decompression arm 51A during operation after the engine is started. The centrifugal force F1 moves the decompression arm 51A in the opening direction resisting the spring force F2 of the spring 56A, and the decompression arm 51A is positioned at the decompression releasing position P2. The decompression pin 48A is operated by the tip end of the decompression arm 51A to direct the flat surface 47A of the decompression cam 46A toward the opening side of the accommodation groove 36A. Therefore, the decompression cam 46A is immersed in the base circle of the exhaust cam 33A to avoid contact between the valve tappet 25A and the decompression cam 46A, thereby releasing decompression.

In the cylinder 21A (one cylinder) in which combustion occurs first, the decompression operation time is not immediately after the combustion of the cylinder 21B (the other cylinder) (see FIG. 4). The decompression operation time of the cylinder 21A is during the exhaust stroke of the cylinder 21B, and at the decompression operation time of the cylinder 21A, combustion of the cylinder 21B does not cause a sudden change in the rotation speed to the acceleration side. Therefore, when passing over the valve tappet 25A during operation, the decompression of the cylinder 21A does not malfunction, and the contact between the valve tappet 25A and the decompression cam 46A is avoided, and thus occurrence of compression loss and abnormal noise in the cylinder 21A is prevented.

As illustrated in FIG. 8A, the decompression device 40B for the cylinder 21B in which combustion occurs later is attached to the exhaust camshaft 31 in an opposite direction to that of the decompression device 60 of the comparative example. A base end of the decompression arm 51B is connected to the decompression holder 41B on a trailing side of the exhaust camshaft 31 in the rotation direction, and a tip end of the decompression arm 51B is connected to the decompression cam 46B on a leading side of the exhaust camshaft 31 in the rotation direction. That is, the opening direction of the decompression arm 51B of the decompression device 40B is opposite to the rotation direction of the exhaust camshaft 31. The decompression arm 51B is swingably supported between the decompression operating position P1 and the decompression releasing position P2.

When the engine is started, the centrifugal force F1 does not strongly act on the decompression arm 51B. The decompression arm 51B is pulled in the closing direction by the spring force F2 of the spring 56B, and the decompression arm 51B is positioned at the decompression operating position P1. The decompression cam 46B is connected to the tip end of the decompression arm 51B via the decompression pin 48B, and the flat surface 47B of the decompression cam 46B faces a side surface of the accommodation groove 36B. Therefore, the decompression cam 46B partially protrudes from the base circle of the exhaust cam 33B and comes into contact with the valve tappet 25B (see FIG. 2) from the flat surface 47B side to operate decompression.

As illustrated in FIG. 8B, the centrifugal force F1 acts strongly on the decompression arm 51B during operation after the engine is started. The centrifugal force F1 moves the decompression arm 51B in the opening direction resisting the spring force F2 of the spring 56B, and the decompression arm 51B is positioned at the decompression releasing position P2. The decompression pin 48B is operated by the tip end of the decompression arm 51B to direct the flat surface 47B of the decompression cam 46B toward the opening side of the accommodation groove 36B. Therefore, the decompression cam 46B is immersed in the base circle of the exhaust cam 33B to avoid contact between the valve tappet 25B and the decompression cam 46B, thereby releasing decompression.

In the cylinder 21B (the other cylinder) in which combustion occurs later, the decompression operation time is immediately after the combustion of the cylinder 21A (one cylinder) (see FIG. 4). The decompression operation time of the cylinder 21B is during the combustion stroke of the cylinder 21A, and at the decompression operation time of the cylinder 21B, combustion of the cylinder 21A causes a sudden change in the rotation speed to the acceleration side. Inertial force acts on the decompression arm 51B when passing over the valve tappet 25B during operation, but the decompression does not malfunction because the decompression arm 51B does not move in the closing direction. Contact between the valve tappet 25B and the decompression cam 46B is avoided, and thus occurrence of compression loss and abnormal noise in the cylinder 21B is prevented.

More specifically, as illustrated in FIG. 8C, when the rotation speed of the engine 10 suddenly changes to the acceleration side, not only the centrifugal force F1 and the spring force F2 but also the inertial force F3 acts on the decompression arm 51B. As described above, since the opening direction of the decompression arm 51B is opposite to the rotation direction of the exhaust camshaft 31, the inertial force F3 acts on the decompression arm 51B not in the closing direction but in the opening direction. Since the decompression arm 51B does not move in the closing direction when passing over the valve tappet 25B, the decompression arm 51B is maintained at the releasing position P2 to prevent decompression malfunction during operation.

As described above, according to the decompression device 40 of the present example, the opening directions of the decompression arms 51A and 51B can be changed for each of the cylinders 21A and 21B of the engine 10. In the cylinder 21A, the opening direction of the decompression arm 51A is set in the same direction to the rotation direction of the exhaust camshaft 31 so that the decompression is not easily released when the engine is started. In the cylinder 21B, which is affected by a rotational fluctuation when the decompression cam 46B passes over the valve tappet 25B during operation, the opening direction of the decompression arm 51B is set in the opposite direction to the rotation direction of the exhaust camshaft 31. The decompression does not malfunction by an influence of the rotational fluctuation, and the occurrence of compression loss and abnormal noise is prevented. Since weight adjustment of the decompression arms 51A and 51B and load adjustment of the springs 56A and 56B are not required, an increase in working hours and design changes can be prevented.

In the present example, the opening direction of the decompression arm can be changed depending on the attachment orientation of the decompression holder with respect to the exhaust camshaft, but the decompression device only needs to be configured so that the opening direction of the decompression arm can be changed.

In the present example, an engine with two cylinders with unequal combustion intervals of 270 degrees and 450 degrees is exemplified, but the combustion interval and the number of cylinders can be changed as appropriate as long as the engine is a multi-cylinder engine.

The decompression device of the present example is not limited to the straddle-type vehicle described above, and may be employed in other vehicles such as a four-wheeled motor vehicle. The straddle-type vehicle is not limited to vehicles in general in which a driver rides while straddling a seat, but also includes scooter-type vehicles in which a driver rides without straddling a seat.

As described above, a first aspect is a decompression device (40) that is attached to an exhaust camshaft (31) while the exhaust camshaft is supported by a cylinder head (13), the decompression device including a decompression camshaft (45) formed with a decompression cam (46) that can protrude and be immersed with respect to a base circle of an exhaust cam (33) of the exhaust camshaft, a decompression arm (51) that moves in an opening direction due to centrifugal force accompanying rotation of the exhaust camshaft to protrude the decompression cam, and a spring (56) that moves the decompression arm in a closing direction by spring force resisting the centrifugal force to immerse the decompression cam, where the opening direction of the decompression arm can be changed in a same direction or in an opposite direction to a rotation direction of the exhaust camshaft for each cylinder. According to such configuration, the opening direction of the decompression arm can be changed for each cylinder of the engine. In a normal cylinder, the opening direction of the decompression arm is set in the same direction to the rotation direction of the exhaust camshaft so that the decompression is not easily released when the engine is started. In the cylinder which is affected by a rotational fluctuation when the decompression cam passes over the valve tappet during operation, the opening direction of the decompression arm is set in the opposite direction to the rotation direction of the exhaust camshaft. The decompression does not operate by an influence of the rotational fluctuation and the occurrence of compression loss and abnormal noise is prevented. Since there is no need to adjust a weight of the decompression arm or a load of the spring, an increase in working hours and design changes can be prevented.

According to a second aspect, in the first aspect, the decompression device further includes a decompression holder (41) for holding the decompression camshaft, the decompression arm, and the spring on an outer surface of the exhaust camshaft, where the opening direction of the decompression arm can be changed in the same direction or in the opposite direction to the rotation direction of the exhaust camshaft, depending on an attachment orientation of the decompression holder with respect to the exhaust camshaft. According to such configuration, an orientation of the opening direction of the decompression arm can be easily changed depending on the attachment orientation of the decompression holder.

A third aspect is an engine (10) including the decompression device of the first and second aspects, and a cylinder body (12) in which a plurality of cylinders (21) are formed, where combustion intervals of the plurality of cylinders are unequal intervals. According to such configuration, the decompression operation time of the other cylinder is likely to come immediately after combustion of one cylinder. However, by setting the opening direction of the decompression arm of the other cylinder in the direction opposite to the rotation direction of the exhaust camshaft, the decompression operation due to a rotational fluctuation is prevented.

According to a fourth aspect, in the third aspect, two cylinders are provided with unequal intervals of 270 degrees and 450 degrees in the combustion intervals of the plurality of cylinders, and the opening direction of the decompression arm of one cylinder in which combustion occurs first is a same as the rotation direction of the exhaust camshaft, and the opening direction of the decompression arm of the other cylinder in which combustion occurs later is opposite to the rotation direction of the exhaust camshaft. According to such configuration, the decompression operation time of the other cylinder comes immediately after combustion of one cylinder, but by setting the opening direction of the decompression arm of the other cylinder in the opposite direction to the rotation direction of the exhaust camshaft, decompression operation due to rotational fluctuation is prevented.

Although the present example is described, another example may be a combination of the above-described example and a modification example in whole or in part.

The technology of the present invention is not limited to the above-described example, and may be variously changed, replaced, and modified without departing from the spirit of the technical idea. When the technical idea can be realized in another way by advancement of technology or another derived technology, the method may be used for implementation. Therefore, the claims cover all implementations that may fall within the scope of the technical concept.

What is claimed is:

1. An engine including a cylinder body in which a plurality of cylinders are formed, the engine comprising:

an exhaust camshaft supported by a cylinder head; and a plurality of decompression devices attached to the exhaust camshaft, wherein each of the decompression devices includes:

a decompression camshaft formed with a decompression cam that can protrude and be immersed with respect to a base circle of an exhaust cam of the exhaust camshaft;

a decompression arm that moves in an opening direction due to centrifugal force accompanying rotation of the exhaust camshaft to protrude the decompression cam;

a spring that moves the decompression arm in a closing direction by spring force resisting the centrifugal force to immerse the decompression cam; and a decompression holder for holding the decompression camshaft, the decompression arm, and the spring on an outer surface of the exhaust camshaft, in one of the decompression devices a base end of the decompression arm is connected to the decompression holder on a leading side in a rotation direction of the exhaust camshaft and a tip end of the decompression arm is connected to the decompression cam on a trailing side in the rotation direction, and in another one of the decompression devices the base end of the decompression arm is connected to the decompression holder on the trailing side in the rotation direction and the tip end of the decompression arm is connected to the decompression cam on the leading side in the rotation direction, so that the opening direction of the decompression arm of the one of the decompression devices is in a same direction as the rotation direction of the exhaust camshaft and the opening direction of the decompression arm of the another one of the decompression devices is in an opposite direction to the rotation direction of the exhaust camshaft depending on an attachment orientation of the decompression holders with respect to the exhaust camshaft.

2. The engine according to claim 1, wherein combustion intervals of the plurality of cylinders are unequal intervals.

3. The engine according to claim 2, wherein two cylinders of the plurality of cylinders are provided with unequal intervals of 270 degrees and 450 degrees in the combustion intervals of the plurality of cylinders, and the opening direction of the decompression arm of one cylinder of the two cylinders in which combustion occurs first is a same as the rotation direction of the exhaust camshaft, and the opening direction of the decompression arm of the other cylinder of the two cylinders in which combustion occurs later is opposite to the rotation direction of the exhaust camshaft.

* * * * *